US007320578B2

(12) United States Patent
Iizuka

(10) Patent No.: US 7,320,578 B2
(45) Date of Patent: Jan. 22, 2008

(54) COMPRESSOR

(75) Inventor: Jiro Iizuka, Isesaki (JP)

(73) Assignee: Sanden Corporation, Gunma (JP)

( * ) Notice: Subject to any disclaimer, the term of this patent is extended or adjusted under 35 U.S.C. 154(b) by 810 days.

(21) Appl. No.: 10/790,860

(22) Filed: Mar. 3, 2004

(65) Prior Publication Data

US 2004/0179952 A1 Sep. 16, 2004

(30) Foreign Application Priority Data

Mar. 13, 2003 (JP) ..... 2003-067937
Feb. 17, 2004 (JP) ..... 2004-040675

(51) Int. Cl.
*F01C 21/04* (2006.01)

(52) U.S. Cl. ..... 418/97; 418/97

(58) Field of Classification Search ..... 418/100, 418/97, DIG. 1, 313; 417/269; 55/434, 55/462, 467, 392, 447
See application file for complete search history.

(56) References Cited

U.S. PATENT DOCUMENTS 3,867,115 A * 2/1975 Heintzelman ..... 96/408
4,280,799 A * 7/1981 Struve et al. ..... 418/97
4,441,871 A * 4/1984 Boller ..... 418/97
5,114,322 A * 5/1992 Caillat et al. ..... 418/55.6
5,246,357 A * 9/1993 Sjoholm et al. ..... 418/97
7,029,243 B2 * 4/2006 Ono ..... 417/313
2006/0110266 A1 * 5/2006 Higuchi ..... 417/313

FOREIGN PATENT DOCUMENTS

JP 2001295767 10/2001

* cited by examiner

*Primary Examiner*—Devon Kramer
*Assistant Examiner*—Vikansha Dwivedi
(74) *Attorney, Agent, or Firm*—Baker Botts L.L.P.

(57) ABSTRACT

A compressor includes a housing for accommodating a compression mechanism, and an oil separator including a cylindrical body having inner and outer cylinders defining therebetween an annular oil separating chamber and fixed in a communication passage of the housing. The outer cylinder is spaced from a communication passage-forming portion of the housing to define a gap therebetween, extends along a slit formed in the communication passage-forming portion of the housing, and is formed with an opening directed tangential to the oil separating chamber and facing part of the slit. Gas discharged from the compression mechanism flows through the slit and the opening into the oil separating chamber to form a swirl flow, so that lubricating oil is centrifugally separated from the gas. Part of the gas collies with an outer face of the outer cylinder, whereby lubricating oil is separated from the gas.

11 Claims, 4 Drawing Sheets

COMPRESSOR

CROSS-REFERENCE TO THE RELATED ART

This nonprovisional application claims priority under 35 U.S.C. § 119(a) on Patent Application Nos. 2003-067937 and 2004-40675 filed in Japan on Mar. 13, 2003 and Feb. 17, 2004, respectively, the entire contents of which are hereby incorporated by reference.

BACKGROUND OF THE INVENTION

1. Field of the Invention

The present invention relates to a compressor having an oil separator.

2. Description of the Related Art

A compressor is known which comprises a compression mechanism for sucking and compressing gas that contains lubricating oil; a housing in which the compression mechanism is accommodated and which is formed with an outlet (discharge port), a discharge chamber communicating with the compression mechanism, and a communication passage extending from the discharge chamber to the outlet; and a centrifugal separator, disposed in the communication passage of the housing, for separating the lubricating oil from the gas discharged from the compression mechanism.

This kind of compressor is disclosed in Japanese provisional patent publication No. 2001-295767, which comprises a centrifugal separator including a cylindrical body having a large diameter portion and a small diameter portion and fixed in a communication passage of a housing with its large diameter portion directed to a downstream side in the direction of gas flow. An annular oil separating chamber is defined between the small diameter portion of the cylindrical body and a communication passage-forming portion of the housing. An opening formed in the housing communicates with the oil separating chamber and is directed tangential to the annular oil separating chamber.

The compressor disclosed in the above-mentioned publication is designed to cause the gas discharged from the compression mechanism to swirl in the oil separating chamber, so that the lubricating oil is separated from the gas by means of a centrifugal force acting on the swirling gas.

SUMMARY OF THE INVENTION

The object of the present invention is to provide a compressor having an oil separator whose oil separating ability is enhanced.

According to the present invention, there is provided a compressor which comprises a compression mechanism for sucking, compressing and discharging gas that contains lubricating oil; a housing having a compression mechanism-accommodation space for accommodating the compression mechanism and formed with an outlet, a discharge chamber communicating with the compression mechanism, and a communication passage extending from the discharge chamber to the outlet; and an oil separator, disposed in the communication passage of the housing, for separating the lubricating oil from the gas that is discharged from the compression mechanism. The oil separator includes a cylindrical body having inner and outer cylinders defining therebetween an annular oil separating chamber having a closed end, the cylindrical body being press-fitted to and fixed in the communication passage, with an end portion thereof on a side near the closed end of the oil separating chamber directed to a downstream side in a direction of gas flow. The outer cylinder is spaced from a communication passage-forming portion of the housing so as to define a gap therebetween, extends along a slit formed in the communication passage-forming portion of the housing, and is formed with an opening so as to be directed tangential to the oil separating chamber and to face part of the slit. The gap communicates with the inner cylinder which in turn communicates with the oil separating chamber and the outlet.

In the compressor of this invention, a most part of the gas discharged from the compression mechanism to the discharge chamber passes through the opening of the outer cylinder and that part of the slit of the housing which faces the opening, and flows into the annular oil separating chamber to form a swirl flow therein. As a result, a centrifugal force is applied to the gas, and lubricating oil is separated from the gas and adheres to an inner face of the outer cylinder. The gas from which the lubricating oil is separated flows from the oil separating chamber into the inner cylinder, and passes through part of the communication passage on a downstream side of the cylindrical body in the direction of gas flow and through the outlet of the housing, to be discharged from the compressor. The remaining part of the gas discharged from the compression mechanism to the discharge chamber passes through that part of the slit of the housing which does not face the opening formed in the outer cylinder, collides with an outer face of the outer cylinder, and then flows into the gap between the communication passage-forming portion of the housing and the outer cylinder. As a result of the collision, lubricating oil is separated from the gas. The gas from which the lubricating oil is separated passes through the gap to flow into the inner cylinder, and passes through part of the communication passage on the side downstream of the cylindrical body in the direction of gas flow and through the outlet of the housing, to be discharged from the compressor.

As explained above, the compressor of this invention separates the lubricating oil from the gas not only by means of centrifugal force, but also by means of collision, and is hence improved in its oil separating ability.

In this invention, the compression mechanism may be a swash plate type compression mechanism or a scroll type compression mechanism. Thus, the present invention is applicable to a swash plate type compressor and a scroll type compressor.

The compressor may be provided with a calming chamber formed outside the outer cylinder and communicating with the oil separating chamber. In this case, the lubricating oil separated from the gas is stored in the calming chamber instead in the oil separating chamber, whereby the separated lubricating oil is prevented from being discharged from the compressor by being involved into the swirl gas flow. In case that the claming chamber is provided in the cylindrical body, the compressor is easy to fabricate, as compared to a case where the calming chamber is formed in the housing.

The housing may be formed with a second communication passage through which the calming chamber communicates with the compression mechanism-accommodation space of the housing. In this case, the lubricating oil stored in the calming chamber can be returned to the compression mechanism-accommodation space through the second communication passage.

A throttle valve may be disposed in the second communication passage. The throttle valve is opened/closed to make it possible to return a proper amount of the lubricating oil from the calming chamber to the compression mechanism-accommodation space, thereby maintaining a proper amount of lubricating oil in the compression mechanism-accommodation space.

The throttle valve may be provided with a pressure-sensitive device, especially when the compression mechanism is of a variable displacement swash plate type. In this case, depending on the pressure of the fluid, the pressure-sensitive device operates to cause the throttle valve to open or close, so that the introduction of the fluid into the compression mechanism-accommodation space through the second communication passage is permitted or prohibited, thereby variably controlling the inclination angle of a swash plate, by extension, the discharge capacity of the compressor.

Alternatively, the throttle valve may be controlled in accordance with an external signal indicative of load of the compressor, whereby similar advantages can be achieved.

In the case of a scroll type compressor, a stationary scroll of the compressor may be formed with an orifice hole through which the calming chamber communicates with the compression mechanism-accommodation space of the housing. In this case, the lubricating oil stored in the calming chamber can be returned to the compression mechanism-accommodation space through the orifice hole, making it possible to maintain a proper amount of lubricating oil in the compression mechanism-accommodation space.

The cylindrical body may be constituted by a resin material. In this case, the cylindrical body can be light in weight so that it becomes easy to be assembled, and can easily be formed into a complicated shape.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

In the following, compressors of this invention will be described.

Figure 1:
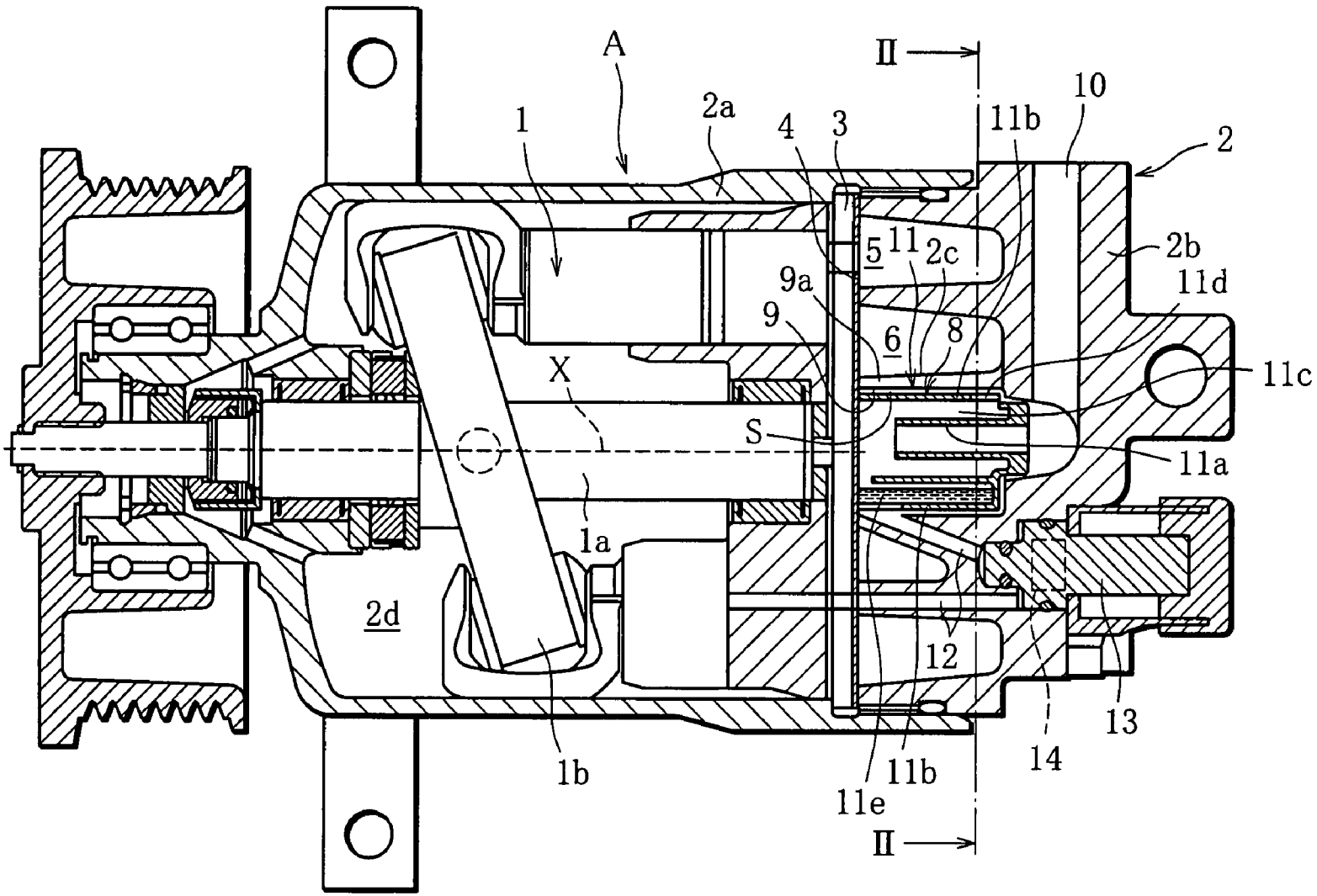
FIG. 1 is a longitudinal section view of a compressor according to a first embodiment of this invention.

As shown in FIG. 1, a compressor A according to a first embodiment comprises a variable displacement swash plate type compression mechanism 1 for sucking, compressing and discharging refrigerant gas that contains lubricating oil mist, and a housing 2 comprised of a front housing 2*a* and a cylinder head 2*b*. The compression mechanism 1 includes a main shaft 1*a* which extends horizontally when the compressor A is in operation. The compression mechanism 1 is disposed adjacent to the cylinder head 2*b*, with a valve plate 3 and a gasket 4 interposed therebetween. The valve plate 3 forms one end portion of the compression mechanism 1. A suction chamber 5 and a discharge chamber 6 are formed in the cylinder head 2. The suction chamber 5 communicates with an inlet or suction port 7 (FIG. 2) formed in the cylinder head 2*b*, and also communicates with the compression mechanism 1 through a suction hole formed in the valve plate 3 and a suction valve attached to the valve plate 3. The discharge chamber 6 communicates with the compression mechanism 1 through a discharge hole formed in the valve plate 3 and a discharge valve attached to the valve plate 3.

The compressor A comprises a centrifugal separator 8 serving as an oil separator for separating lubricating oil from refrigerant gas discharged from the compression mechanism 1.

Figure 2:
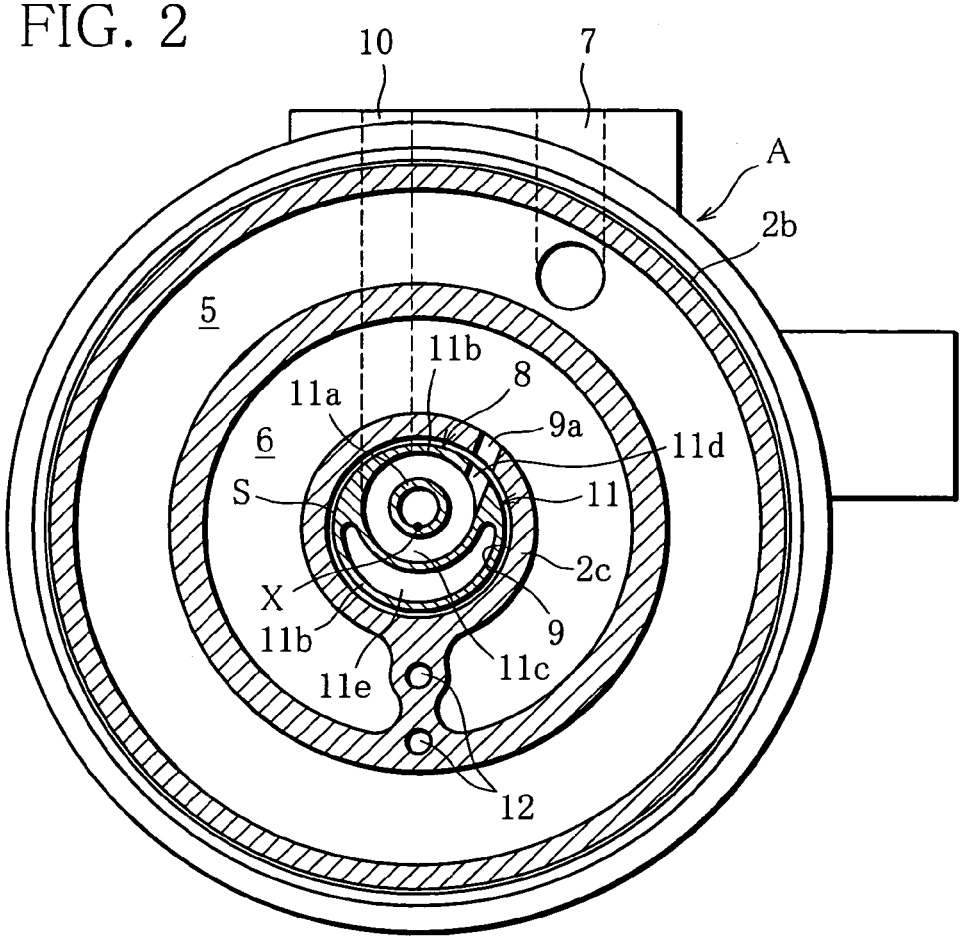
FIG. 2 is a transverse section view of the compressor taken along line II-II shown in FIG. 1.

As shown in FIGS. 1 and 2, the centrifugal separator 8 comprises a columnar recess 9 formed in the cylinder head 2*b* so as to extend in parallel to a center axis X of the main shaft 1*a* of the compression mechanism 9. In other words, the cylinder head 2*b* has a radially inner peripheral wall (shown at 2*c* in FIG. 1) serving as a recess-forming portion (communication passage-forming portion) for defining the columnar recess 9 that forms part of the below-mentioned communication passage. The inner peripheral wall of the cylinder head 2*b* is formed with a slit 9*a* extending in parallel to the center axis X of the main shaft 1*a*. The columnar recess 9 communicates with the discharge chamber 6 through the slit 9*a*. The columnar recess 9 has one end thereof communicating with an outlet or discharge port 10 formed in the cylinder head 2*b* through a passage 9' formed in the cylinder head 2*b*, and another end thereof closed by the gasket 4. The columnar recess 9 cooperates with the passage 9' to form a communication passage extending between the discharge chamber 6 and the outlet 10.

Figure 3:
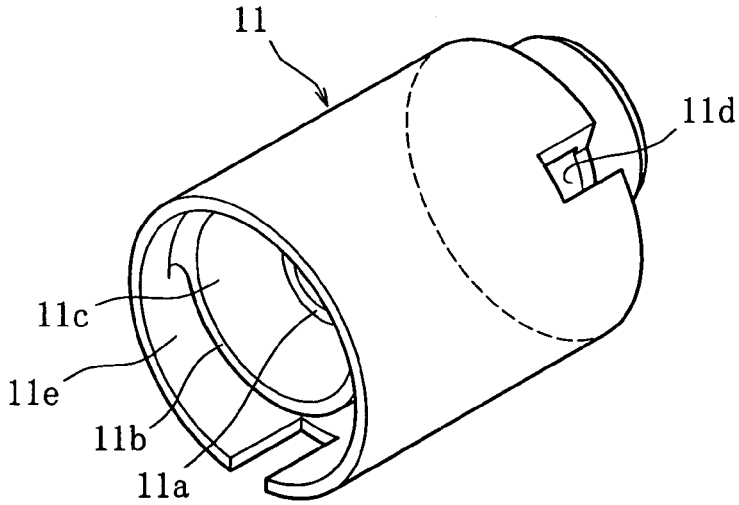
FIG. 3 is a perspective view of a cylindrical body shown in FIG. 1.

The centrifugal separator 8 comprises a cylindrical body 11 comprised of inner and outer cylinders 11*a* and 11*b* disposed coaxially with each other and defining therebetween a circular annular oil separating chamber 11*c* whose one end is closed. The outer cylinder 11*b* has its portion near the closed end of the oil separating chamber 11*c* and formed with an opening 11*d* that is directed tangential to the circular annular oil separating chamber 11*c* as viewed in transverse section, as shown in FIGS. 2 and 3. The cylindrical body 11 is fitted to the columnar recess 9, with the opening 11*d* directed upward. The cylindrical body 11 has its axially outer end portion (on the side near the closed end of the oil separating chamber 11*c*) that is fixed by press-fitting to a cylinder head portion corresponding to a connection between the passage 9' and an axially outer end portion of the columnar recess 9 (on the side near the outlet 10). A minute gap S is formed between the outer cylinder 11 and the radially inner peripheral wall 2*c* of the cylinder head 2*b* that defines the columnar recess 9. The opening 11*d* of the cylindrical body 11 is disposed to face an axial part of the slit 9*a* formed in the inner peripheral wall 2*c* of the cylinder head 2*b*. The outer cylinder 11*b* extends along the slit 9*a*.

The slit 9*a* is directed tangential to the circular annular oil separating chamber 11*c* as viewed in transverse section. A pillar-shaped space is defined between respective end portions of the inner and outer cylinders 11*a*, 11*b* on the side remote from the closed end of the oil separating chamber 11*c*. The inner cylinder 11*a* communicates with the oil separating chamber 11*c* through the pillar-shaped space, and communicates with the outlet 10 through the passage 9'.

The cylindrical body 11 is provided with a calming chamber 11*e* that is formed outside of and below the outer body 11*b* and communicates with the oil separating chamber 11*c*. A notch 11*f* is formed in that end portion of a bottom wall of the cylindrical body 11 defining the calming chamber 11*e* which is on the side remote from the closed end of the oil separating chamber 11*c*. Through the notch 11*f*, the minute gap S communicates with the inner cylinder 11*a*. The calming chamber 11*e* communicates with a compression mechanism-accommodation space 2*d* in the front housing 2 through the notch 11*f* and a second communication passage 12 formed in the cylinder head 2*b*. In the middle of the second communication passage 12, a throttle valve 13 is disposed, which is provided with a pressure-sensitive device (shown in FIG. 1 by dotted line with reference numeral 14) such as bellows, diaphragm, or the like that operates to open or close the throttle valve 13 and the second communication passage 12.

In the following, the operation of the compressor A having the aforementioned construction will be explained.

With rotation of the main shaft 1*a* of the compression mechanism 1, refrigerant gas containing lubricating oil mist is sucked into the compression mechanism 1 through the suction port 7 and the suction chamber 5. The refrigerant gas is compressed by the compression mechanism 1 and discharged therefrom. A most part of the refrigerant gas discharged to the discharge chamber 6 passes through the slit 9*a* of the cylinder head 2*b* and the opening 11*d* of the outer cylinder 11 and flows into the circular annular oil separating chamber 11*c* of the separator 8 in the direction tangential to the oil separating chamber 11*c* as viewed in transverse section. The refrigerant gas flowing into the chamber 11*c* in this manner forms a swirl flow in the oil separating chamber 11*c*. Thus, a centrifugal force is applied to the refrigerant gas, and lubricating oil is separated from the refrigerant gas. The separated lubricating oil adheres to an inner peripheral face of the outer cylinder 11*b*, and flows downward along the inner peripheral face of the cylinder 11*b* to flow into the calming chamber 11*e*. On the other hand, the refrigerant gas from which lubricating oil is separated flows from the oil separating chamber 11*c* to the inner body 11*a* of the cylindrical body, and is discharged from the compressor A through the passage 9' downstream of the cylindrical body 11 in the direction of refrigerant gas flow and the outlet 10.

The remaining part of the refrigerant gas discharged from the compression mechanism 1 as mentioned above passes through that part of the slit 9*a* which does not face the opening 11*d* and collides with an outer face of the outer cylinder 11*b*. At the time of the collision, lubricating oil is separated from the refrigerant gas. The lubricating oil separated by the collision flows downward after passing through the gap S between the radially inner peripheral wall 2*c* of the cylinder head 2*b* and the outer cylinder 11*b*, and passes through the notch 11*f* to flow into the calming chamber 11*e*. On the other hand, the refrigerant gas from which the lubricating oil is separated in the oil separating chamber 11*c* passes through the gap S and the notch 11*f* to flow into the inner cylinder 11*a*, and is then discharged from the compressor A via the passage 9' and the outlet 10.

The refrigerant gas discharged from the compressor A is supplied to air conditioner equipment via a pipe (not shown) attached to the outlet 10.

During the operation of the compressor A, when thermal load of the air conditioner equipment varies, the pressure in the discharge chamber 6 varies accordingly. The pressure-sensitive device 14 of the throttle valve 13 responds to a variation in the pressure in the discharge chamber 6 to cause the throttle valve 13 to open or close, whereby the second communication passage 12 is open or closed. When the second communication passage 12 is open, the refrigerant gas in the discharge chamber 6 flows through the second communication passage 12 into the compression mechanism accommodating space 2*d* in the front housing 2*a*. When the second communication passage 12 is closed, the refrigerant gas is prevented from flowing into the compression mechanism-accommodation space 2*d*. As a result of the introduction of the refrigerant gas to the compression mechanism-accommodation space 2*d* being allowed or prohibited, the inclination angle of the swash plate (shown at 1*b* in FIG. 1) of the variable displacement swash plate type compression mechanism 1 is variably controlled, whereby the discharge capacity of the compressor A is variably controlled.

When the refrigerant gas in the discharge chamber 6 flows through the second communication passage 12 into the compression mechanism-accommodation space 2*d* as mentioned above, the lubricating oil stored in the calming chamber 11*e* is entrained in the refrigerant gas and returned to the compression mechanism-accommodation space 2*d* through the second communication passage 12 and the throttle valve 13.

As explained in the above, the compressor A forms the swirl flow of the refrigerant gas containing lubricating oil in the oil separating chamber 11*c*, so that a centrifugal force is applied to the refrigerant gas, whereby the lubricating oil is separated from the refrigerant gas. In addition, the compressor A causes part of the refrigerant gas flowing toward the oil separating chamber 11*c* to collide with the outer face of the outer cylinder 11*b*, thereby separating the lubricating oil from the refrigerant gas. Therefore, the compressor A is improved in its lubricating oil separating ability, as compared with the prior art compressor.

In the compressor A, the cylindrical body 11 is fixed by press-fitting only the axially outer end thereof to the cylinder head portion corresponding to the connection between the columnar recess 9 and the passage 9', and the gap S is formed between the outer cylinder 11*b* and the radially inner peripheral wall 2*c* of the cylinder head 2*b* that defines the columnar recess 9, making it easy to mount the cylindrical body 11 to the housing 2, as compared to a case where the cylindrical body 11 is as a whole press-fitted to the columnar recess 9 formed in the housing 2.

The compressor A is provided with the calming chamber 11*e* formed outside of and below the outer cylinder 11*b* of the cylindrical body 11 and communicating with the oil separating chamber 11*c*, and the lubricating oil, separated from the refrigerant gas by means of the centrifugal separation in the oil separating chamber 11*c* and by means of the collision between the refrigerant gas and the outer cylinder 11*b*, is caused to flow along the outer cylinder 11*b* to enter the calming chamber 11*c* in which the separated lubricating oil is stored, instead in the oil separating chamber 11*c*. This makes it possible to prevent the separated lubricating oil from being discharged from the compressor A by being entrained in the fluid that will flow into the inner cylinder 11*a* and will be discharged from the compressor. The compressor A having the cylindrical body 11 provided with the calming chamber 11*e* is easy to fabricate, as compared to a case where the calming chamber is formed in the cylinder head 2*b* separately from the cylindrical body 11.

In the following, a compressor according to a second embodiment of this invention will be explained with reference to FIG. 4.

Figure 4:
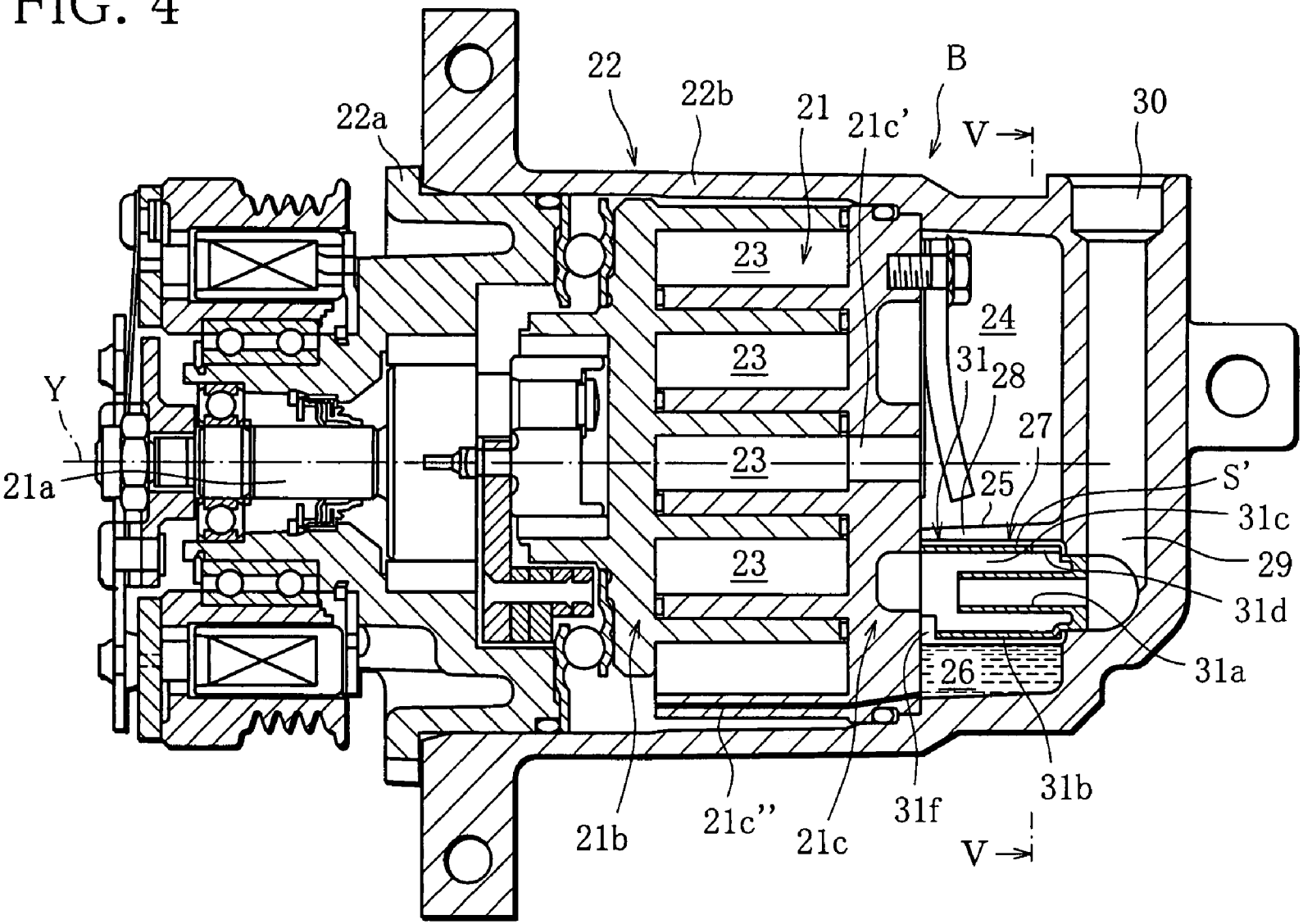
FIG. 4 is a longitudinal section view of a compressor according to a second embodiment of this invention.

As shown in FIG. 4, a compressor B according to the second embodiment comprises a scroll type compression mechanism 21 for sucking, compressing and discharging refrigerant gas that contains lubricating oil mist, and a housing 22, comprised of a front housing 22*a* and a rear housing 22*b*, for accommodating the compression mechanism 21. The compression mechanism 21 includes a main shaft 21*a* which extends horizontally when the compressor B is in operation. The compression mechanism 21 includes a movable scroll 21*b* revolvingly driven by the main shaft 21*a*, and a stationary scroll 21*c* meshing with the movable scroll 21*b* to form a workspace 23 for refrigerant compression. A discharge chamber 24 is formed at the rear of the stationary scroll 21*c*, and communicates with the workspace 23 through a discharge hole 21*c*' formed in the stationary scroll 21*c*. The rear housing 22*b* includes a partition wall 25 extending substantially in parallel to the center axis Y of the main shaft 21*a* and interposed between the discharge chamber 24 and a chamber 26 defined beneath the discharge chamber 24.

The compressor B comprises a centrifugal separator 27 serving as an oil separator for separating lubricating oil from refrigerant gas discharged from the compression mechanism 21.

Figure 5:
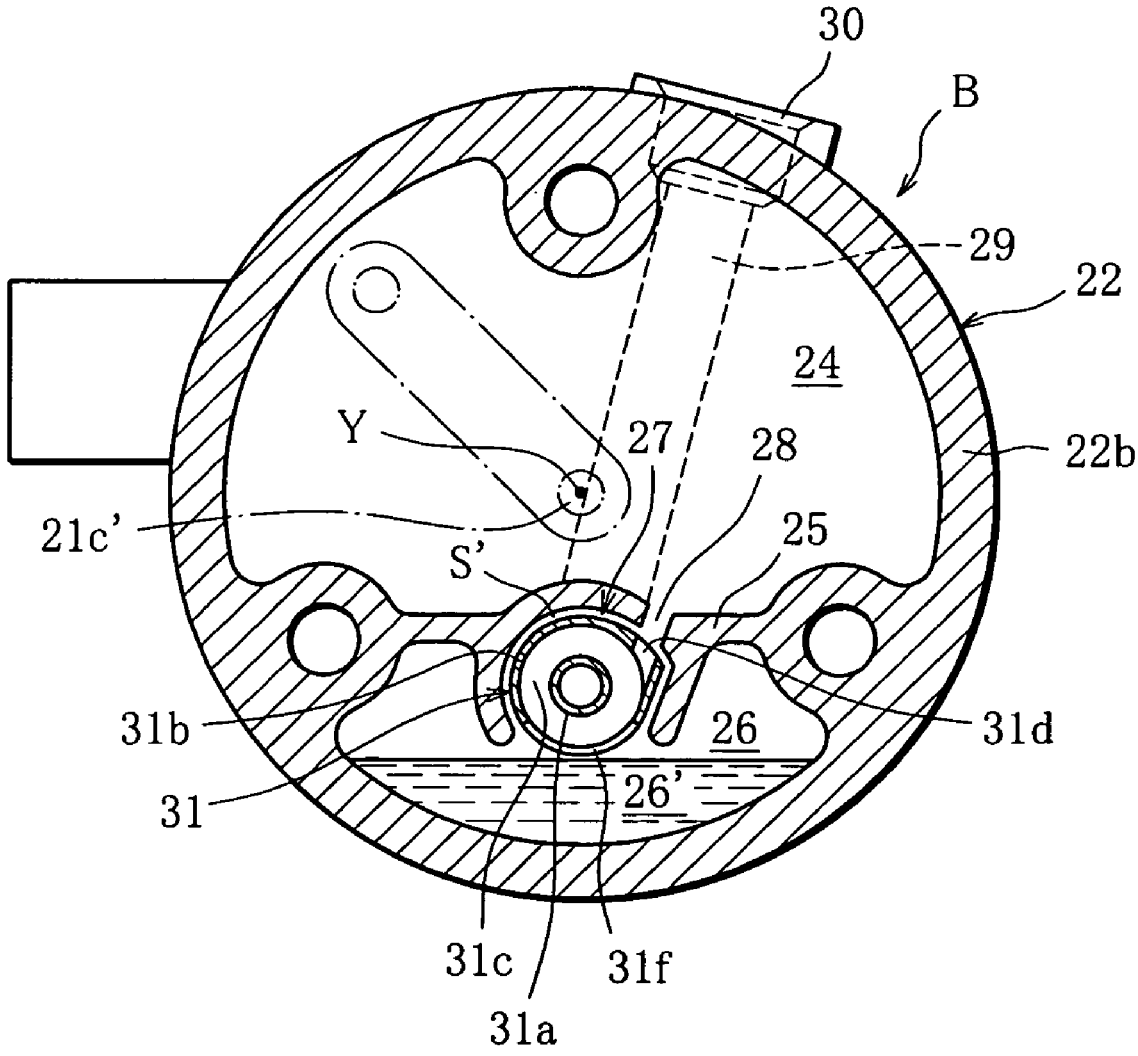
FIG. 5 is a transverse section view of the compressor taken along line V-V shown in FIG. 4.

As shown in FIGS. 4 and 5, the centrifugal separator 27 comprises a slit 28 formed in the partition wall 25 and extending substantially in parallel to the center axis Y of the main shaft 21*a*. The chamber 26 communicates with an outlet or discharge port 30 formed in the rear housing 22*b* through a passage 29 formed in the rear housing 22*b*. The chamber 26 cooperates with the passage 29 to form a communication passage extending between the discharge chamber 24 and the outlet 30.

The centrifugal separator 27 comprises a cylindrical body 31 comprised of inner and outer cylinders 31*a* and 31*b* disposed coaxially with each other and defining therebetween a circular annular oil separating chamber 31*c* whose one end is closed. The outer cylinder 31*b* has its portion near the closed end of the oil separating chamber 31*c* and formed with an opening 31*d* that is directed tangential to the circular annular oil separating chamber 31*c* as viewed in transverse section, as shown in FIG. 5. The cylindrical body 31 is disposed in the chamber 26 beneath the partition wall 25, with the opening 31*d* directed upward. The cylindrical body 31 has its end portion, on the side of the closed end of the oil separating chamber 31*c*, which is fixed by press fitting to a housing portion corresponding to a connection between the chamber 26 and the passage 29.

The outer cylinder 31*b* cooperates with the partition wall 25 to define a minute gap S' therebetween, and extends along the slit 28. The opening 31*d* of the cylindrical body 31 is disposed to face an axial part of the slit 28. The slit 29 is directed tangential to the circular annular oil separating chamber 31*c* as viewed in transverse section. A pillar-shaped space is defined between respective end portions of the inner and outer cylinders 31*a*, 31*b* on the side remote from the closed end of the oil separating chamber 31*c*. The inner cylinder 31*a* communicates with the oil separating chamber 31*c* through the pillar-shaped space, and communicates with the outlet 30 through the passage 29.

The chamber 26 has a part positioned outside of and below the outer body 31*b* and forming a calming chamber 26' that communicates with the oil separating chamber 31*c* through a notch 31*f* formed in the bottom of that end portion of the outer body 31*b* which is on the side remote from the closed end of the oil separating chamber 31*c*. Through the notch 31*f*, the minute gap S' communicates with the inner cylinder 31*a*. The calming chamber 26' communicates with a compression mechanism-accommodation space in the rear housing 22*b* through an orifice hole 21*c*" formed in the stationary scroll 21*c*.

In order to reduce the weight of the stationary scroll 21, an end face of the stationary scroll 21 on the side near the discharge chamber 24 is formed with two reliefs, as shown by two rectangles above and below the discharge hole 21*c*' in FIG. 2. In case that the lower relief has substantially the same diameter as that of the outer cylinder 31*b* (oil separating chamber 31*c*), the inner cylinder 31*a* can be extended in the axial direction, making it possible to improve the oil separation function. In FIG. 4, a semicircle near the lower end of the passage 29 indicates a hole formed in the rear housing 22*b* and used for mounting the oil separator 27.

In the compressor B, with rotation of the main shaft 21*a* of the compression mechanism 21, refrigerant gas containing lubricating oil mist is sucked into the compression mechanism 21 through a suction port, not shown. The refrigerant gas is compressed by the compression mechanism 21 and discharged therefrom.

A most part of the refrigerant gas discharged to the discharge chamber 24 passes through the slit 29 and the opening 31*d* and flows into the circular annular oil separating chamber 31*c*. The refrigerant gas flowing into the circular annular oil separating chamber 31*c* in the direction tangential to the chamber 31*c* as viewed in transverse section forms a swirl flow in the oil separating chamber 31*c*, and thus lubricating oil is centrifugally separated from the refrigerant gas. The separated lubricating oil adheres to an inner peripheral face of the outer cylinder 31*b*, and flows downward along the inner peripheral face of the cylinder 31*b* to flow into the calming chamber 26' after passing the notch 31*f*. The refrigerant gas from which lubricating oil is separated flows from the oil separating chamber 31*c* to the inner body 31*a* of the cylindrical body, and is discharged from the compressor B through the passage 29 downstream of the cylindrical body 31 in the direction of refrigerant gas flow and the outlet 30.

The remaining part of the refrigerant gas discharged to the discharge chamber 24 collides with an outer face of the outer cylinder 31*b* after passing through that part of the slit 28 which does not face the opening 31*d*, and flows into the gap S'. When the refrigerant gas collies with the outer face of the outer cylinder 31*b*, lubricating oil is separated from the refrigerant gas. The lubricating oil separated by the collision flows downward after passing through the gap S', and flows into the calming chamber 26'. The refrigerant gas from which the lubricating oil is separated passes through the gap S' and the notch 31*f* to flow into the inner cylinder 31*a*, and is then discharged from the compressor B via the passage 29 and the outlet 30.

The refrigerant gas discharged from the compressor B is supplied to air conditioner equipment via a pipe (not shown) attached to the outlet 30.

The lubricating oil stored in the calming chamber 26' is returned to the compression mechanism-accommodation space through the orifice hole 21*c*".

In the compressor B, the lubricating oil is separated from the refrigerant gas not only by means of centrifugal force but also by means of collision, and therefore, the compressor B is improved in its lubricating oil separating ability, as compared with the prior art compressor.

In the compressor B, the cylindrical body 31 can easily be assembled onto the housing 22 so as to be interposed in the communication passage between the discharge chamber 24 and the outlet 30, by press-fitting and fixing an end portion of the cylindrical body 31 on the side near the closed end of the oil separating chamber 31*c* to the housing portion corresponding to the connection between the chamber 26 and the passage 29.

The compressor B is provided with the calming chamber 26' formed outside of and below the outer cylinder 31*b* and communicating with the oil separating chamber 31*c* through the notch 31*f*, and thus the lubricating oil separated from the refrigerant gas in the oil separating chamber 31*c* is stored in the calming chamber 26', instead in the oil separating chamber 31*c*. As a result, the lubricating oil separated in the oil separating chamber 31*c* is prevented from being discharged from the compressor B by being involved in the swirl flow of refrigerant gas.

Although the constituent material of the cylindrical body 11, 31 in the first and second embodiments is not especially limited, the cylindrical body 11, 31 made of a resin material is light in weight, easy to mount, and can be formed into a complicated shape with ease.

The present invention is not limited to the foregoing embodiment, and may be modified variously.

For example, one end of the columnar recess 9 is closed by the gasket 4 in the first embodiment. Alternatively, the one end of the columnar recess may be closed by the valve plate 3. In the first embodiment, the pressure-sensitive device 14, which responds to a variation in the pressure in the discharge chamber 6 that occurs due to a variation in thermal load of the air conditioner equipment, is provided in the throttle valve 13 for open/close control of the throttle valve in order to variably control the discharge capacity of the compressor A in dependence on a variation in thermal load of the air conditioner equipment. Instead of using the pressure-sensitive device 14, an external signal indicative of thermal load of the air conditioner equipment may be used for the control of the throttle valve 13.

The present invention is widely applicable to various compressors including a swash plate type compressor and a scroll type compressor.

What is claimed is:

1. A compressor comprising:

a compression mechanism for sucking, compressing and discharging gas that contains lubricating oil;

a housing having a compression mechanism-accommodation space for accommodating said compression mechanism and formed with an outlet, a discharge chamber communicating with said compression mechanism, and a communication passage extending from the discharge chamber to the outlet; and an oil separator, disposed in the communication passage of said housing, for separating the lubricating oil from the gas that is discharged from said compression mechanism, said oil separator including a cylindrical body having inner and outer cylinders defining therebetween an annular oil separating chamber having a closed end, wherein said cylindrical body being press-fitted to and fixed in the communication passage, with an end portion thereof on a side near the closed end of the oil separating chamber directed to a downstream side in a direction of gas flow, said outer cylinder is spaced from a communication passage-forming portion of said housing so as to define a gap therebetween, extends along a slit formed in the communication passage-forming portion of said housing, and is formed with an opening so as to be directed tangential to the oil separating chamber and to face part of the slit, and said gap communicates with the inner cylinder which in turn communicates with the oil separating chamber and the outlet.

2. The compressor according to claim 1, wherein said compression mechanism is a swash plate type compression mechanism.

3. The compressor according to claim 2, further comprising:

a calming chamber formed outside the outer cylinder and communicating with the oil separating chamber.

4. The compressor according to claim 3, wherein said housing is formed with a second communication passage through which the calming chamber communicates with the compression mechanism-accommodation space of said housing.

5. The compressor according to claim 4, wherein a throttle valve is disposed in the second communication passage.

6. The compressor according to claim 5, wherein said throttle valve is provided with a pressure-sensitive device.

7. The compressor according to claim 5, wherein said throttle valve is controlled in accordance with an external signal indicative of load of the compressor.

8. The compressor according to claim 1, wherein said compression mechanism is a scroll type compression mechanism.

9. The compressor according to claim 8, further comprising:

a calming chamber formed outside the outer cylinder and communicating with the oil separating chamber.

10. The compressor according to claim 9, wherein a stationary scroll of the compressor is formed with an orifice hole through which the calming chamber communicates with the compression mechanism-accommodation space of said housing.

11. The compressor according to any one of claims 1-10, wherein said cylindrical body is constituted by a resin material.

* * * * *